US005233800A

United States Patent [19]

Sasaki et al.

[11] Patent Number: 5,233,800

[45] Date of Patent: Aug. 10, 1993

[54] EARTHQUAKE-PROOFING DEVICE OF PERIPHERALLY RESTRAINING TYPE

[75] Inventors: Teruo Sasaki, Nishinomiya; Yoshiaki Miyamoto, Takarazuka; Makoto Sakuraoka, Kobe, all of Japan

[73] Assignees: Sumitomo Gomu Kogyo Kabushiki Kaisha, Hyogo; Sumitomo Kensetsu Kabushiki Kaisha, Tokyo, both of Japan

[21] Appl. No.: 983,996

[22] Filed: Dec. 1, 1992

Related U.S. Application Data

[63] Continuation of Ser. No. 595,647, Oct. 9, 1990, abandoned, which is a continuation of Ser. No. 423,744, Oct. 19, 1989, abandoned, which is a continuation of Ser. No. 217,923, Jun. 17, 1988, abandoned.

[30] Foreign Application Priority Data

Oct. 28, 1986 [JP] Japan ..... 61-256397
May 14, 1987 [JP] Japan ..... 62-117296

[51] Int. Cl.[5] ..... E07D 27/34

[52] U.S. Cl. ..... 52/167 R

[56] References Cited

U.S. PATENT DOCUMENTS

| | | | |
|---|---|---|---|
| 3,782,788 | 1/1974 | Koester | 14/16.1 |
| 3,806,106 | 4/1974 | Hamel | 267/152 |
| 3,920,231 | 11/1975 | Harrison . | |
| 3,924,907 | 12/1975 | Czernik | 14/16.1 |
| 3,938,852 | 2/1976 | Hein | 14/16.1 |
| 4,033,005 | 7/1977 | Czernik | 14/16.1 |
| 4,499,694 | 2/1985 | Buckle | 52/167 |
| 4,593,502 | 6/1986 | Buckle | 52/167 |
| 4,633,628 | 1/1987 | Mostaghel | 52/167 |
| 4,633,628 | 1/1987 | Mostaghel | 52/167 |
| 4,695,169 | 9/1987 | Baigent | 14/16.1 |
| 4,713,917 | 12/1987 | Buckle | 52/167 |
| 4,781,361 | 11/1988 | Makibayashi | 267/219 |

FOREIGN PATENT DOCUMENTS

| | | | |
|---|---|---|---|
| 51-38699 | 9/1976 | Japan . | |
| 51-38700 | 9/1976 | Japan . | |
| 59-179907 | 10/1984 | Japan . | |
| 1404169 | 8/1975 | United Kingdom | 384/37 |
| 2034436 | 6/1980 | United Kingdom . | |
| 2139735 | 11/1984 | United Kingdom . | |

*Primary Examiner*—Friedman: Carl D.
*Assistant Examiner*—Creighton Smith
*Attorney, Agent, or Firm*—Nikaido Marmelstein Murray & Oram

[57] ABSTRACT

The present invention relates to an earthquake-proofing device wherein a superstructure is placed and supported for horizontal movement on a foundation structure so as to increase the natural vibration period of the superstructure, thereby protecting the superstructure against earthquake energy and traffic vibration. More particularly, the outer periphery of an elastic body, visco-elastic body or viscous body which hardly exhibits rigidity by itself is surrounded by a restrainer which restrains it from bulging outward, thereby enabling the body to develop high vertical rigidity while allowing it to retain horizontal deformability, the body being used as a load carrier. The restrainer and/or load carrier absorbs vibration energy by frictional damping action. According to this construction, besides the above-described basic performance essential to earthquake-proofing devices, there are the following advantages: (1) The points of action of the restoring force and damping force coincide with each other, so that the structure is protected against unnecessary torsional vibration; (2) the range of selection of materials for the load carrier is wide, so that characteristics can be designed in a wide range as desired; and (3). The initial shear rigidity at the start of vibration is so low that the structure can also be protected against slight vibration.

33 Claims, 17 Drawing Sheets

FIG.13
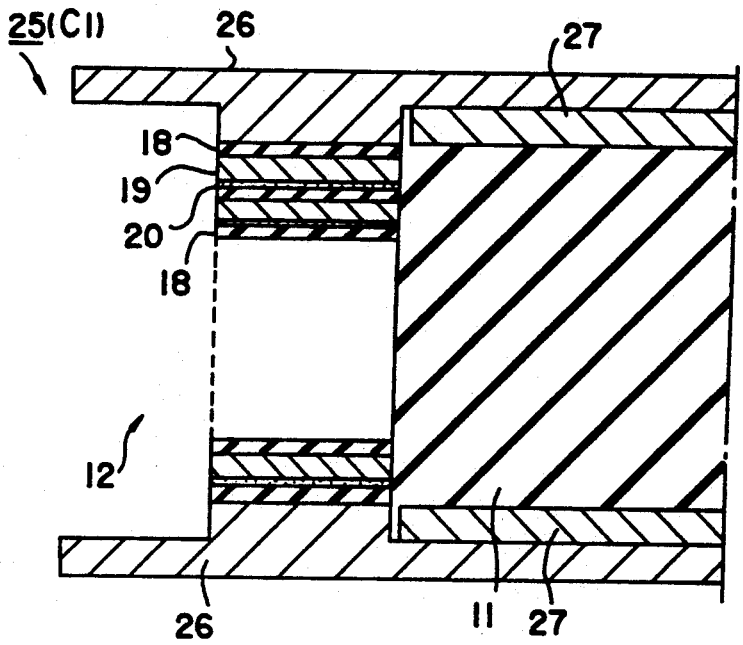
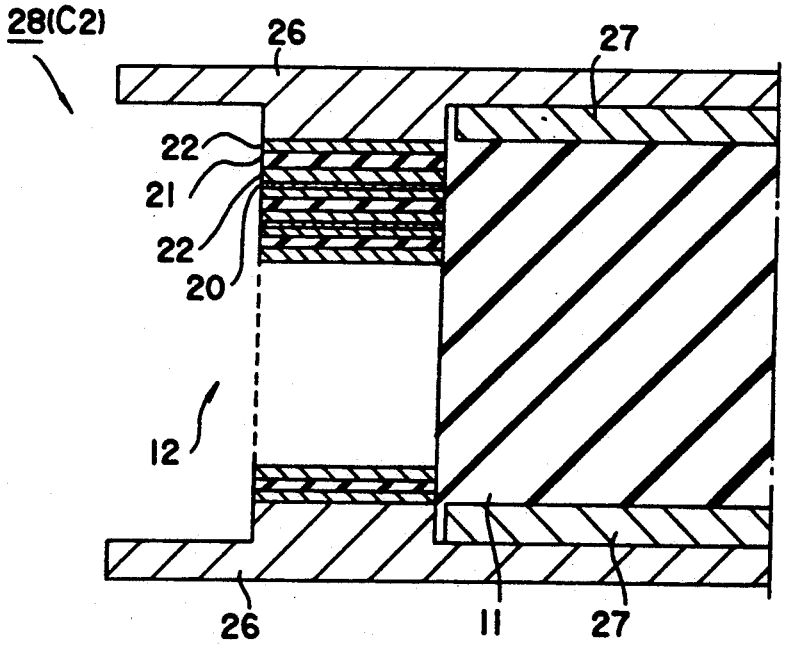
FIG.14

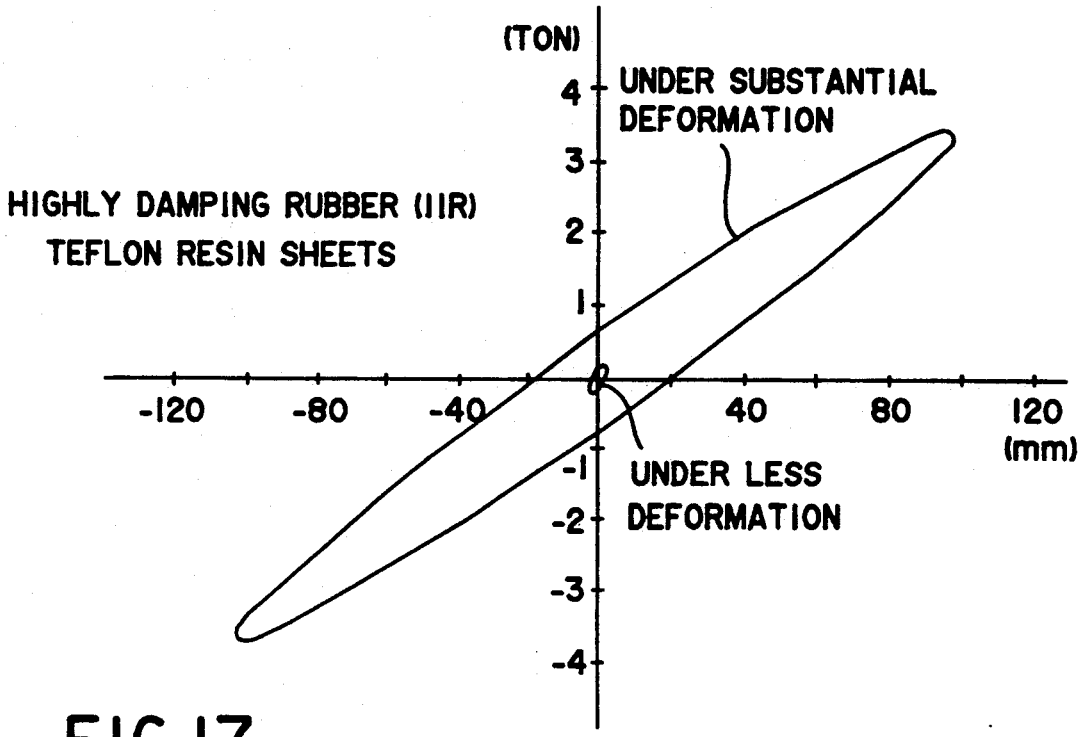
FIG.17
FIG.18(a)
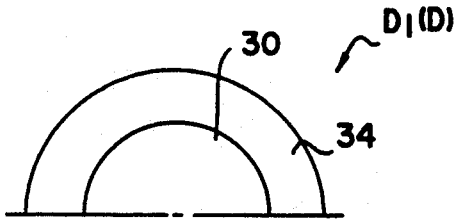
FIG.18(b)
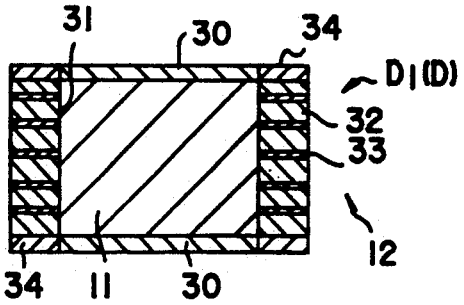

EARTHQUAKE-PROOFING DEVICE OF PERIPHERALLY RESTRAINING TYPE

This application is a continuation of prior application Ser. No. 595,647, filed on Oct. 9, 1990, now abandoned, which is a continuation of application Ser. No. 423,744, filed on Oct. 19, 1989, now abandoned, which is a continuation of application Ser. No. 217,923, filed on Jun. 17, 1988, now abandoned.

TECHNICAL FIELD

The present invention relates to an earthquake-proofing device of peripherally restrained type for carrying or supporting a structure while reducing earthquake input and vibration-proofing the structure, and particularly to a vibration-proofing device of peripherally restrained type using an elastic, visco-elastic or viscous body as a load carrier externally surrounded by restraining laminated members to impart a high vertical rigidity to the device while allowing the device to deform horizontally to a great extent, so that the device is capable of earthquake-proofing and vibration-proofing structures and machines.

BACKGROUND ART

As for earthquake-proofing systems for structures including buildings, laminated rubber bearings have come into wide use, and they are classified into three types.

A first type, as shown in FIGS. 29(*a*) and (*b*), is a laminated rubber bearing X, wherein rubber plates 1 which are low in compression permanent strain, such as natural rubber, and steel plates 2 are alternately laminated and fixed together. Since this type has a high ratio of vertical compression rigidity to horizontal shear rigidity, it reduces transmission of earthquake energy to a structure while stably supporting the structure, which is a heavy object, against earthquakes.

A second type is a lead-laminated rubber bearing Y (Japanese Patent Publication No. 17984/1986) which is a modification of the laminated construction used for the first type of laminated rubber bearing, incorporating a lead plug 3, as shown in FIGS. 30(*a*) and (*b*), vertically inserted therein. Thanks to hysteresis damping provided by plastic strain of the lead inserted in the interior as indicated by a load-displacement curve shown in FIG. 31, this type reduces the amplitude of vibration of a structure produced by an earthquake and quickly damps the vibrations.

A third type is a highly damping laminated rubber bearing Z, which is a modification of the laminated rubber bearing X shown in FIGS. 29(*a*) and (*b*), wherein the laminate itself is given a damping property by using highly damping rubber for rubber plates 1.

However, the aforesaid laminated rubber bearings X, Y and Z have the following respective problems.

The first type of laminated rubber bearing X has a vibration damping property which is so low that the direct use of the same will result in an increased amplitude of vibration of a structure during an earthquake; thus, the bearing lacks safety. Therefore, usually, in use it is combined with a separate damper disposed in parallel therewith. In this case, the point of action of restoring force does not coincide with the point of action of damping force, so that there is the danger of giving unnecessary torsional vibrations to the structure.

In the second type of lead-laminated rubber bearing Y, the lead plug 3 develops a high initial shear rigidity for slight vibration, as shown by a characteristic S in FIG. 31; thus, the bearing has poor vibration proofing performance such that it transmits traffic vibrations produced by passage of vehicles. Therefore, it can hardly be applied to a building or floor for installing machines where vibrations are objectionable. Another problem is that the restoration to the original point subsequent to substantial deformation is retarded by the plasticity of the lead.

In the third type of highly damping laminated rubber bearing Z, the amount of creep of the highly damping rubber is high and its restoring force associated with horizontal displacement is low; thus, there is a problem that the reliability for prolonged use is low. Further, the amount of creep differs from one highly damping laminated rubber bearing to another, so that as a result of the earthquake-proofing action, the building shows non-uniform subsidence, causing unnecessary stresses to be produced in the structure.

DISCLOSURE OF THE INVENTION

The present invention has been accomplished with the actual conditions of the laminated rubber bearings X, Y and Z taken into consideration and is intended to propose an earthquake-proofing device which solves the problems on the basis of a construction and principle basically different from those of the rubber bearings.

An earthquake-proofing device of peripherally restrained type newly proposed by the invention is characterized in that it comprises:

a load carrier adapted to be disposed below a structure to support the vertical load therefrom, and a restrainer including restraining members laminated together in the direction of the height to develop high rigidity against tensile force, said load carrier being inserted in said restrainer, said restrainer restraining the load carrier from bulging outward.

In said earthquake-proofing device, the load carrier formed of an elastic, visco-elastic or viscous material is restrained by the surrounding restrainer, whereby it develops a load support capability due to vertical rigidity while retaining the high deforming capability due to elasticity, visco-elasticity or viscosity. The restrainer and/or load carrier develops a vibration energy absorbing effect mainly by frictional damping. This vibration absorbing effect is also effective for slight vibration.

In addition, in the earthquake-proofing device of the invention, a vertical load is supported mostly by the load carrier, while energy absorption is effected mainly by frictional damping through the restrainer and/or load carrier; in this respect, the mechanism differs essentially from the lead-laminated rubber bearing Y. The reason is that in the lead-laminated rubber bearing Y, a vertical load is supported by the surrounding laminate of steel plates and thin rubber plates while energy absorption is effected by the plastic deformation of the lead.

Further, in the construction of the present inventive device, the point of action of restoring force coincides with the point of action of damping force, so that unnecessary torsional vibrations are not given to structures.

It is seen from the above that the present inventive device serving as a damper-integral type earthquake-proofing device develops the same performance as or higher performance than the conventional laminated rubber bearings X, Y and Z.

Since a columnar load carrier is restrained by the restrainer, it has become possible to utilize those kinds of materials for load carriers that it was not possible to use in the case of laminated construction.

BRIEF DESCRIPTION OF THE DRAWINGS

FIG. 1 is a sectional view showing the basic construction; FIGS. 2 and 3 are a plan view and a sectional view, respectively, showing an example of application; and FIG. 4 is a side view showing another example of application.

FIG. 5 is a sectional view showing the basic construction; FIG. 6 is a plan view; FIG. 7 is a fragmentary enlarged sectional view of FIG. 5; FIG. 8 is a perspective view showing restraining wires; and FIG. 9 is a fragmentary sectional view showing another example of arrangement of the peripheral portion of the load carrier.

FIGS. 10 through 17 are views for explaining an earthquake-proofing device C according to a third embodiment of the invention; FIGS. 10(*a*) and (*b*), FIGS. 11(*a*) and (*b*) and FIGS. 12(*a*) and (*b*) show three examples of the basic construction of the third embodiment, (a)'s being plan views and (b)'s being sectional views. FIG. 13 is a sectional view showing a manufacture example embodying the basic construction example $C_1$ shown in FIG. 10 and FIG. 14 is a sectional view showing a manufacture example embodying the basic construction example $C_2$ shown in FIG. 11. FIGS. 15 through 17 are load-displacement curves obtained when the rubber-like material and anti-friction material for the load carrier are changed.

FIGS. 18 through 25 are views showing an earthquake-proofing device D according to a fourth embodiment of the invention; FIGS. 18(*a*) and (*b*) are a plan view and a sectional view, respectively, showing a first construction example $D_1$. FIGS. 19(*a*) and (*b*) show a manufacture example $d_1$ of the first construction example $D_1$ shown in FIGS. 18(*a*) and (*b*), (a) being a plan view and (b) being a sectional view. FIGS. 20(*a*) and (*b*) through FIGS. 25(*a*) and (*b*) show second through seventh construction examples of the fourth embodiment, (a)'s being plan views and (b)'s being sectional views.

FIGS. 26(*a*) and (*b*) and FIGS. 27(*a*) and (*b*) show first and second arrangement examples, respectively, (a)'s being plan views and (b)s' being sectional views. FIGS. 28(*a*), (*b*) and (*c*) show a third arrangement example of the fifth embodiment, (a) being a sectional view, (b) being a plan view of an upper pressure receiving plate and (c) being a plan view of an outer plate.

FIGS. 29(*a*) and (*b*) show a laminated rubber bearing X or a highly damping laminated rubber bearing Z, (a) being a plan view and (b) being a sectional view. FIGS. 30(*a*) and (*b*) show a lead-laminated rubber bearing Y, (a) being a plan view and (b) being a sectional view.

DESCRIPTION OF THE PREFERRED EMBODIMENTS

The present inventive device has a number of embodiments corresponding to different forms of the construction of a restrainer. These will now be described in order.

First of all, a first embodiment which is the most basic type of the invention will be described with reference to FIGS. 1 through 4.

Figure 1:
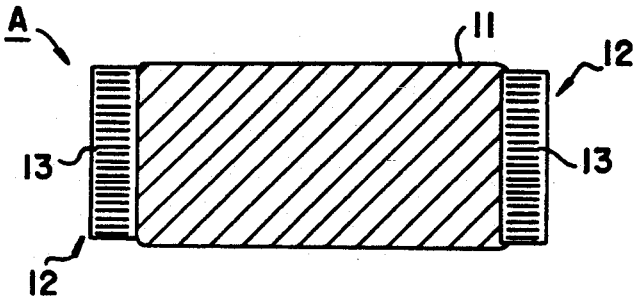
FIGS. 1 through 4 are views showing an earthquake-proofing device A according to a first embodiment of the invention.

An earthquake-proofing device A according to the first embodiment, as shown in FIG. 1 showing its section, comprises a load carrier 11 using a columnar rubber-like body which develops elasticity or viscoelasticity, and restraining plates 13 disposed therearound as restraining members constituting a restrainer 12.

The rubber-like body forming the load carrier 11 is formed into a column having any desired plan configuration including a cylinder and a prism, and its material includes natural rubber and derivatives thereof, and elastomers developing rubber-like visco-elasticity, such as various synthetic rubbers and rubber-like plastics.

Further, since the rubber-like body, which is the load carrier 11, is singly used, such highly damping rubbers as nitrile-butadiene rubber, isobutylene-isoprene rubber, polynorbornene, and butyl halogenide, whose lamination has heretofore been hampered, can be used if necessary.

Disposed in laminate form around the periphery of the load carrier 11 using a rubber-like body are restraining plates 13 of high rigidity which are restraining members constituting the restrainer 12 for restraining outward bulging. Thereby, the load carrier 11 and the earthquake-proofing device A develop high vertical rigidity and great vertical load support capability and possess low horizontal rigidity and great horizontal deformability.

Figure 4:
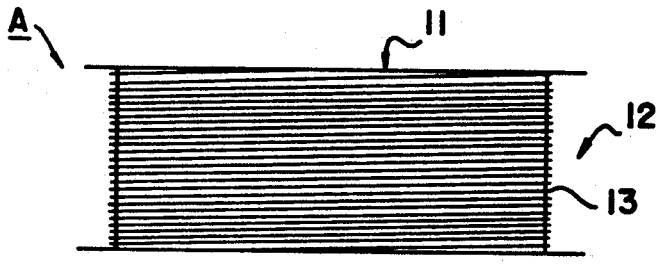

The restrainer 12 shown in FIG. 1 is constructed by simply stacking the restraining plates 13 in the form of a plurality of steel plates, but as in FIG. 4 showing an example of application of the first embodiment, a single or a plurality of steel plates may be made continuous in spiral form, making it possible to arbitrarily adjust the rigidity and damping performance of the earthquake-proofing device A.

As for the method of treating the restraining plates for lamination, they may be directly laminated or they may be covered or laminated using rubber which is low in compression permanent strain.

Another example of applications of the first embodiment will now be described with reference to FIGS. 2 and 3.

In this example of application, fixing plates 14 adapted to be fixed to a superstructure and a substructure are joined to the upper and lower surfaces of the earthquake-proofing device A of the first embodiment, that is, the upper and lower surfaces of the rubber-like body which is the load carrier 11.

Steel plates are mainly used for the fixing plates 14 as in the case of the restrainer 12.

Figure 2:
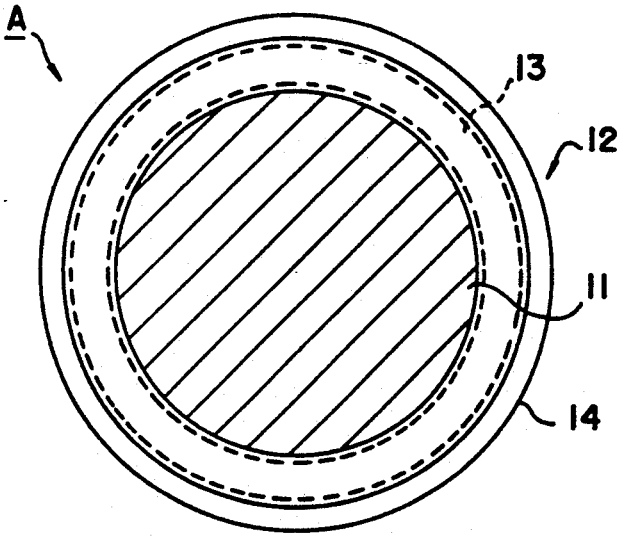
Figure 3:
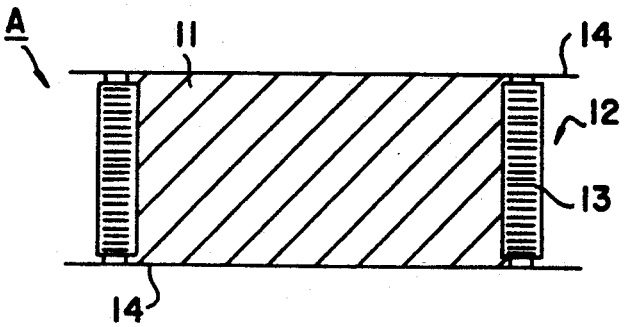

The example of application shown in FIG. 2 is constructed by stacking a plurality of restraining plates 12 which are a plurality of steel plates to form a restrainer 12, while the example of application shown in FIG. 4 is constructed by spirally forming the restraining plates 13 as described above to form a restrainer 12.

Since the first embodiment is constructed by singly using a rubber-like body and disposing the restraining plates 13 in laminate form therearound to form a restrainer 12, the following effects can be attained.

(1) Particularly in the case where the restraining plates 13 are directly laminated, since the construction is simple, manufacture is easy and hence cost reduction is realized.

(2) When the restraining plates 13 placed one above another are disposed so that they rub each other during earthquake-proofing operation, vibration energy is absorbed by friction, so that a damping effect is obtained; thus, even if the rubber-like body which is the load carrier 11 is natural rubber or the like, the device is a damper-integral type earthquake-proofing device.

(3) Further, in the case of a disposition in which the restraining plates 13 rub each other and also in the case of a disposition in which they do not rub each other, it is possible to use highly damping rubber in order to provide a damping effect to the rubber-like body itself. Further, the rigidity and damping performance of the device can be adjusted at will according to the laminated state of the restraining plates 13. For these reasons, a damper-integral type earthquake-proofing device can be designed in a wide range of characteristics.

(4) The rubber-like body which is the load carrier 11 has high durability and high fire resistance since it is protected around its outer periphery and at its upper and lower portions by steel plates or the like.

(5) Since the amount of material used is small, the device is reduced in weight and is easy to transport.

A second embodiment of the invention will now be described with reference to FIGS. 5 through 9.

Figure 5:
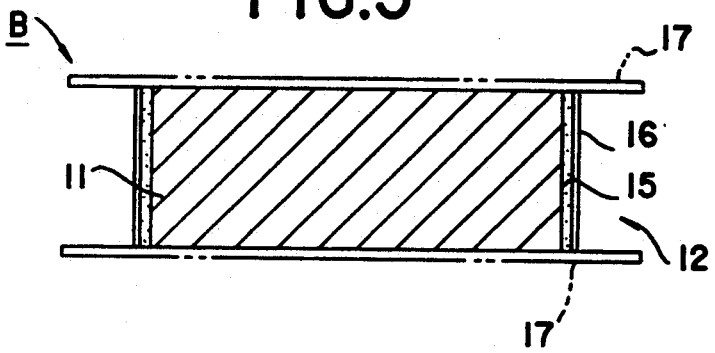
FIGS. 5 through 9 are views showing an earthquake-proofing device B according to a second embodiment of the invention.
Figure 6:
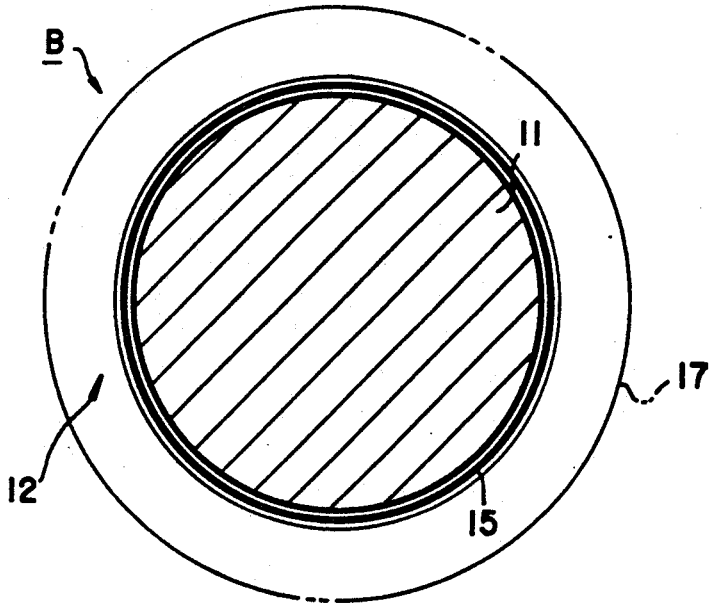

An earthquake-proofing device B according to the second embodiment, as shown in FIGS. 5 and 6, is the same as the first embodiment in that a restrainer 12 for restraining outward bulging is disposed around the periphery of a load carrier 11 using a columnar rubber-like body.

The feature of the second embodiment is that the restrainer 12 is constructed of a number of restraining wires 15 which are restraining members wound in laminate form around the load carrier 11 continuously in the direction of the height.

Figure 7:
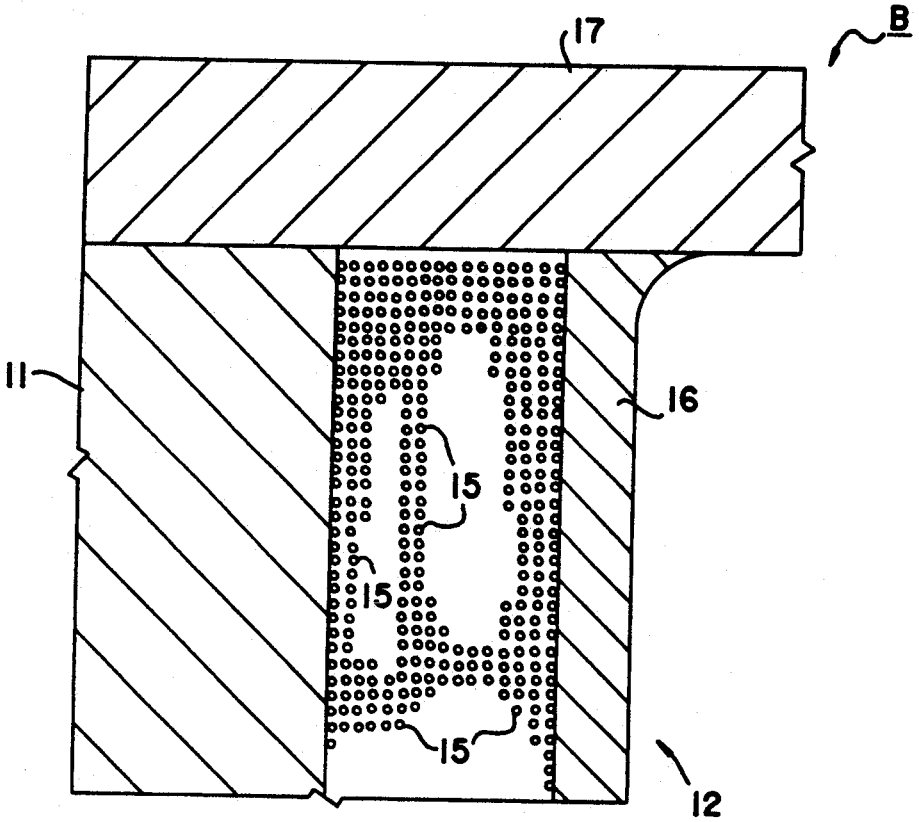
Figure 8:
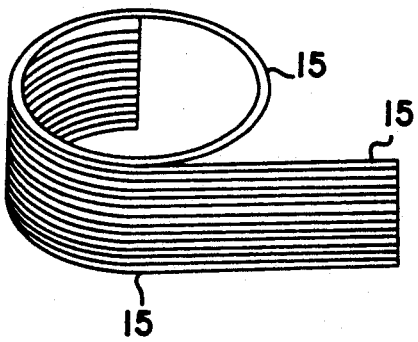

Used for the restraining wires 15 which are restraining members are PC steel wires or wire cords. The restraining wires 15, as shown in FIG. 7 which is a fragmentary enlarged view of the load carrier 11, are disposed in laminate form in the direction of the height and side by side in the horizontal direction. FIG. 8 shows how the restraining wires 15 are assembled. The restraining wires 15 may each be spirally wound so that they are continuous with each other, whereby the rigidity and damping performance of the earthquake-proofing device B can be adjusted at will and the earthquake-proofing device B can be constructed as a damper-integral type, as needed.

The restraining wires 15, as shown in FIG. 7, are protected by being externally covered with an elastic body 16, made of natural rubber or synthetic rubber, which is low in compression permanent strain. The elastic body 16 is integrated with the restraining wires 15 by vulcanization adhesion.

Figure 9:
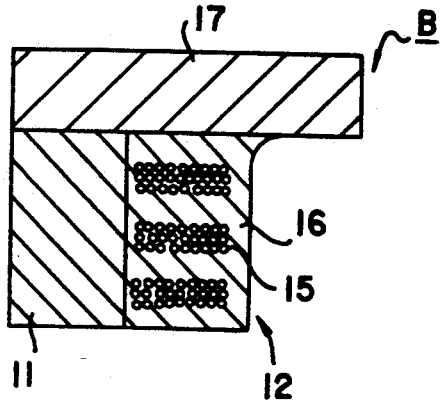

FIG. 9 shows an embodiment wherein groups of restraining wires 15 and an elastic body 16 are disposed in laminate form around a load carrier 11 alternately in the vertical direction.

When the earthquake-proofing device B arranged in the manner described above is used, fixing plates 17 adapted to be fixed to the superstructure and substructure, respectively, are joined to the upper and lower surfaces of the load carrier 11, as shown in FIG. 5.

Since the second embodiment, as described above, is constructed by singly using a rubber-like body as a load carrier and restraining the rubber-like body by a number of restraining wires 15 which are restraining members disposed therearound, the same effect as that of the first embodiment can be obtained.

In the first and second embodiments, when the restraining plates or wires are vertically independent, since vibration energy is absorbed by their frictional energy, the central rubber-like body may be of any kind, though it is preferable that the central rubber-like body has a highly damping property if the restraining plates or wires are fixed by a rubber-like elastic body which is low in compressive permanent strain.

A third embodiment of the invention will now be described with reference to FIGS. 10 through 17.

An earthquake-proofing device C according to the third embodiment of the invention is a developed form of the earthquake-proofing device A according to the first embodiment.

In the earthquake-proofing device A according to the first embodiment, in the case where a horizontal damping effect is provided by dynamic friction between the restraining plates 13 which are restraining members constituting the restrainer 12, vertical minor vibrations attended with noise are produced, a condition undesirable for an earthquake-proofing device. These vibrations become the more severe, the larger the difference between static and dynamic frictions. Thus, the third embodiment provides an arrangement capable of eliminating the vertical vibrations while effectively developing the damping effect due to friction.

First of all, the basic concept of the earthquake-proofing device C according to the third embodiment will be described below.

Figure 11A:
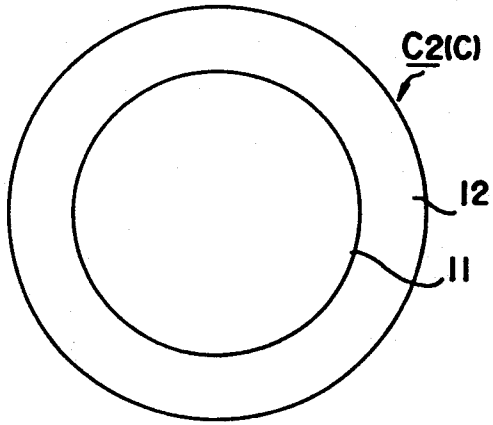
Figure 11B:
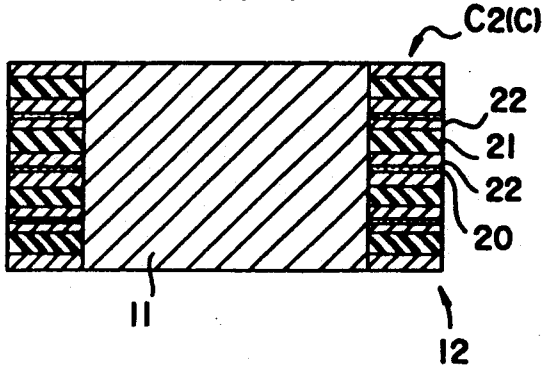
Figure 10A:
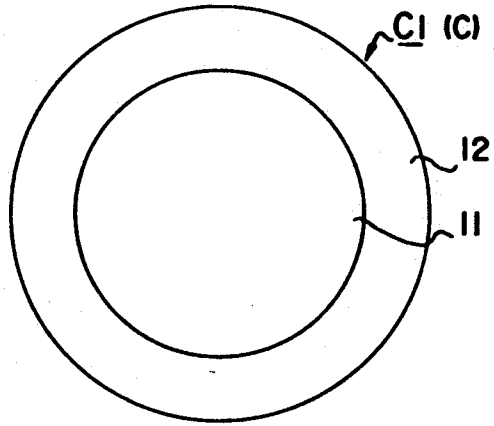
Figure 10B:
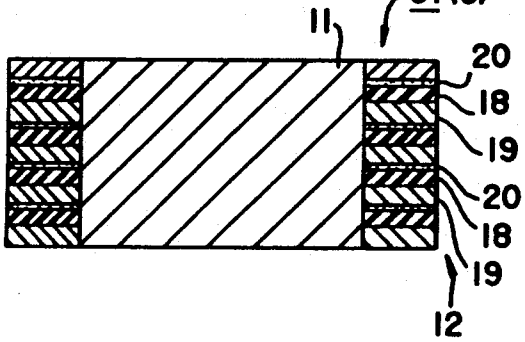
Figure 12A:
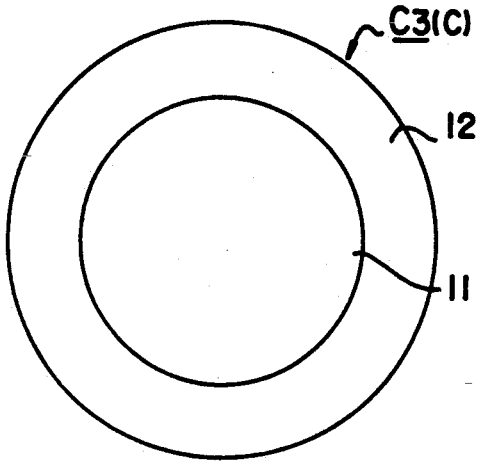
Figure 12B:
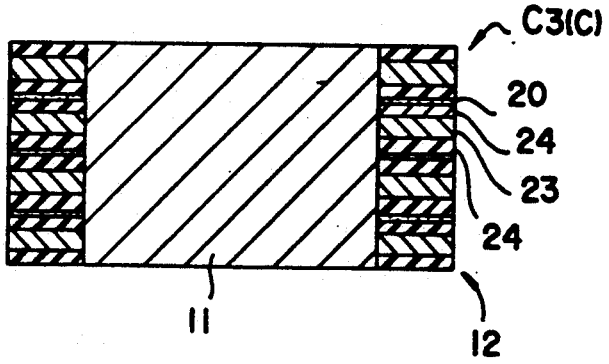

FIGS. 10 through 12 show three basic arrangement examples $C_1$, $C_2$ and $C_3$ of the earthquake-proofing device C according to the third embodiment, the examples differing from each other in the construction of a restrainer 12 disposed in laminate form around a load carrier 11 using a columnar rubber-like body. In the case where the columnar rubber-like body which is a load carrier 11 centrally disposed for supporting a vertical load from a structure uses highly damping rubber, it is preferable that the latter be such that the loss (TAN $\delta$) at $-10°$–$40°$ C. under a dynamic strain of 0.5% at 0.5 Hz is in the range of 0.1–1.5. If the loss (TAN $\delta$) exceeds 1.5, vertical vibration-proofness at above 10 Hz is degraded, while if it is less than 0.1, this does not contribute much to damping performance in a horizontal shear direction.

The respective constructions of the restrainers 12 in the basic arrangement examples $C_1$, $C_2$ and $C_3$ will now be described in order.

The restrainer 12 in the first arrangement example $C_1$ shown in FIGS. 10(*a*) and (*b*) is in the form of a laminate wherein annular rubber-like elastic bodies 18 which are low in compressive permanent strain and annular restraining plates 19 of steel which are restraining members are fixed together face to face and laminated with anti-friction members 20 interposed therebetween. The term "fixing" includes plying, vulcanization adhesion, etc.

The restrainer 12 in the second arrangement example $C_2$ shown in FIGS. 11(*a*) and (*b*) is constructed such that annular restraining plates 22 of steel which are restraining members are fixed one by one to the front and back surfaces of annular rubber-like elastic plates 21 which are low in compression permanent strain to form assemblies of three-layer construction, which are then laminated with anti-friction members 20 interposed therebetween.

The restrainer 12 in the third arrangement example $C_3$ shown in FIGS. 12(*a*) and (*b*) is constructed such that annular rubber-like elastic plates 24 which are low in compression permanent strain are fixed one by one to the front and back surfaces of annular restraining plates 23 of steel which are restraining members to form assemblies of three-layer construction, which are then laminated with anti-friction members 20 interposed therebetween.

As for the restraining elastic plates 19, 22 and 23 which are restraining members, they have only to have high rigidity and high strength against breakdown, and materials other than steel may be used.

As for the rubber-like elastic plates 18, 21 and 24 which are low in compression permanent strain, any elastic material will do so long as it has the same properties as rubber. The amount of compression permanent strain desirable for causing the strainer 12 to develop its effective function is 35% or less, particularly 20% or less at 70° C.-22 HR heat treatment on the basis of JIS K6301.

As for the anti-friction members 20, any material may be used so long as it reduces the difference between static and dynamic frictions between restraining plates; for example, a member impregnated with such a resin low in friction coefficient as silicone grease or PTFE (Teflon lubricant is used. The mounting of these anti-friction members 20 is effected by applying them, through coating or covering, to the slide surfaces of rubber-like elastic plates or by fixing them to the slide surfaces, depending upon their properties.

In addition, the restrainer 12 is not limited to the above arrangement examples; what is essential is that rubber-like elastic plates having a spacer function are fixed to hard restraining plates which are restraining members and that these are laminated with anti-friction members interposed therebetween. For example, if the rubber-like body which is a load carrier 11 is prismatic, the planar shape of the restrainer 12 will be polygonal correspondingly thereto. Further, the restrainer 12 may be a laminate form constructed by spirally winding restraining plates having rubber-like elastic plate fixed thereto.

Manufacture examples embodying the basic arrangement examples of the third embodiment will be described with reference to FIGS. 13 and 14, and their characteristics will be explained.

An earthquake-proofing device 25 shown in FIG. 13 which is a first manufacture example of the third embodiment corresponds to the basic arrangement example $C_1$ previously described with reference to FIG. 10, and in which a columnar rubber-like body which is a load carrier 11 and a restrainer 12 which surrounds it are placed between and fixed to fixing plates 26 which are fixed to the superstructure and substructure.

The load carrier 11 using a rubber-like body has pressure receiving plates 27 embedded therein and bonded thereto on its opposite end surfaces, the material being natural rubber or isobutylene-isoprene rubber whose tan $\delta$ is about 0.3. The thickness ratio of the restraining plates 19 to rubber-like elastic plates 18 which constitute the restrainer 12 is 2:1, and silicone grease having a viscosity of 300,000 cSc (at 25° C.) or Teflon resin sheets are used as the anti-friction members 20.

An earthquake-proofing device 28 shown in FIG. 14 which is a second manufacture example of the third embodiment corresponds to the basic arrangement example $C_2$ previously described with reference to FIG. 11, and it differs from what is shown in FIG. 4 in that the restrainer 12 is formed by laminating three-layer assemblies each comprising two restraining plates 22 and a rubber-like elastic body 21 interposed therebetween. In addition, the thickness ratio of each restraining plate 22 to each rubber-like elastic plate 21 is 1:1.

Figure 15:
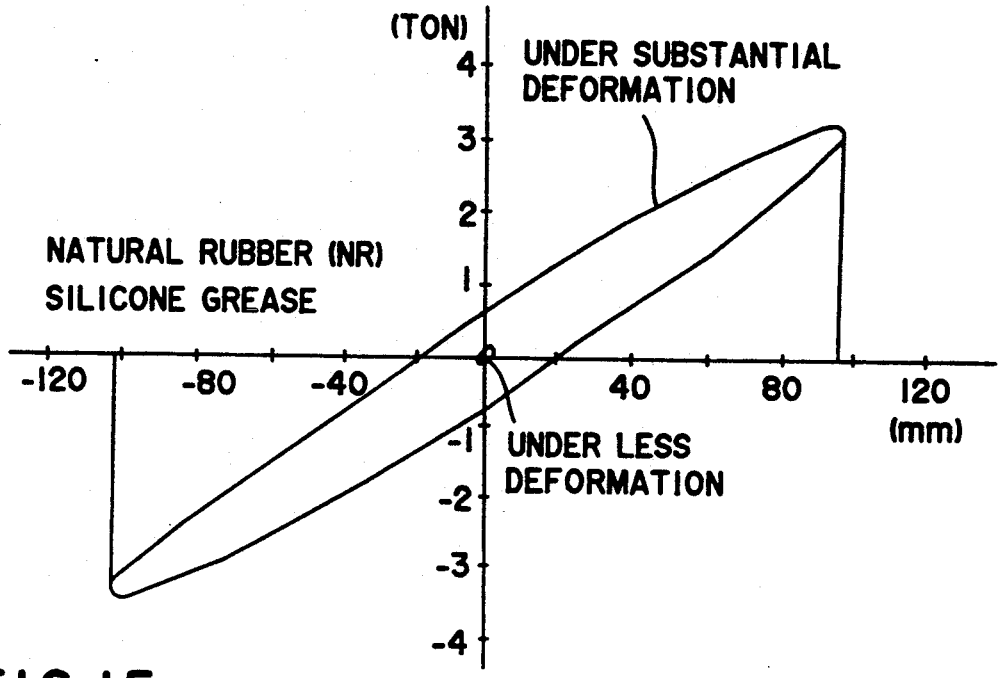
Figure 16:
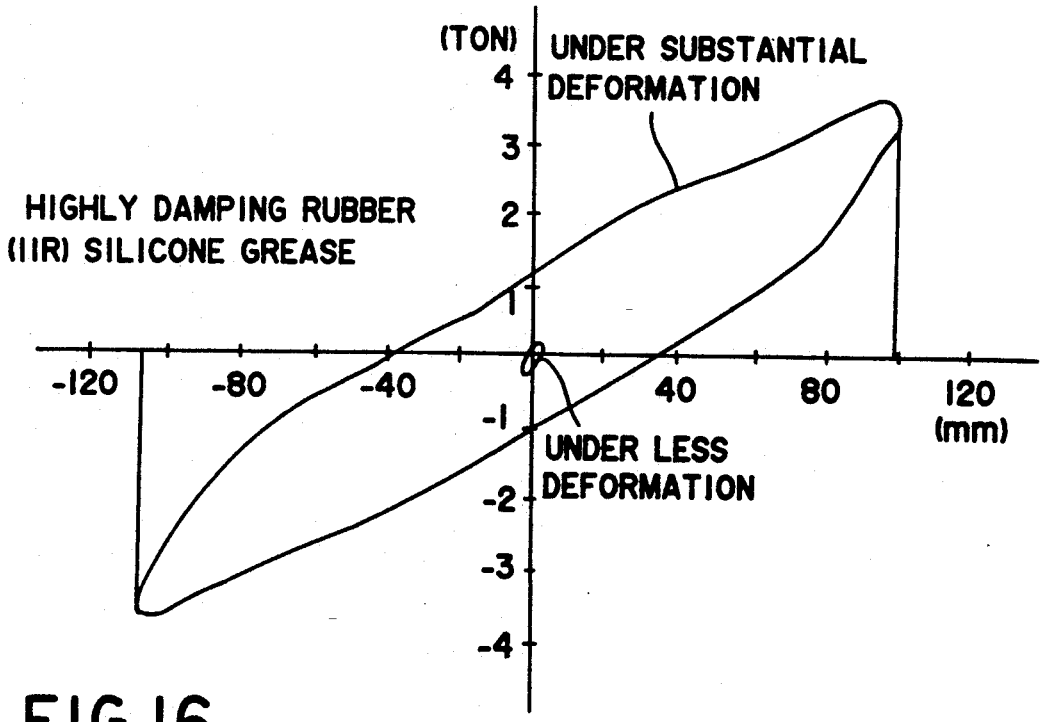

Load-displacement curves obtained by measuring the first manufacture example shown in FIG. 13 are shown in FIGS. 15, 16 and 17. FIG. 15 shows characteristics where the material of the rubber-like body which is the load carrier 11 is natural rubber (NR) and where the anti-friction members 20 are in the form of silicone grease. FIG. 16 shows characteristics where the material of the rubber-like body which is the load carrier 11 is highly damping rubber (IIR) and where the anti-friction members 20 are in the form of silicone grease. FIG. 17 shows characteristics where the material of the rubber-like body which is the load carrier 11 is highly damping rubber and where the anti-friction members 20 are in the form of Teflon resin sheets. In addition, in the earthquake-proofing device 28 which is the second manufacture example, when the materials of the rubber-like body 11 and anti-friction members 20 are selected in the same manner as in the examples described above, the same characteristics as those described above were obtained. When these are compared with the load-displacement curve for the lead-laminated rubber bearing Y, it is seen that the rigidity with respect to slight displacement is low and that a vibration-proofing effect is developed for slight vibration. These comparisons in terms of numerical values are as shown in Table 1.

TABLE 1

| | Shear rigidity (amount of displacement) | | |
|---|---|---|---|
| | 0.5 HZ ± 100 TON/cm | 0.5 HZ ± 2 TON/cm | Damping constant h (displacement ± 100 mm) |
| 1. First manufacture example (FIG. 15) (silicone grease applied + NR parent body) | 0.33 | 0.5 | 0.12 |
| 2. First manufacture example (FIG. 16) (silicone grease applied + IIR parent body) | 0.34 | 1.0 | 0.17 |
| 3. First manufacture example (FIG. 17) (Teflon sheet stuck + IIR parent body) | 0.33 | 0.7 | 0.11 |
| 4. Comparative example (FIG. 28) | 0.42 | 3.0 | 0.19 |

TABLE 1-continued

| | Shear rigidity (amount of displacement) | | |
|---|---|---|---|
| | 0.5 HZ ± 100 TON/cm | 0.5 HZ ± 2 TON/cm | Damping constant h (displacement ± 100 mm) |
| (lead-laminated rubber bering | | | |

That is, in the earthquake-proofing device C according to the third embodiment, the shear rigidity at 2-mm horizontal displacement is ⅓–1/6 of that in the lead-laminated rubber bearing Y, and it is seen that the device exerts good damping performance when encountering slight vibration. Further, in each example, the damping constant h, which is proportional to the area surrounded by the hysteresis curve, exceeds a value of 0.1 generally demanded of earthquake-proofing devices. Particularly, the manufacture example (FIG. 16) using both silicone grease and highly damping rubber provided good results, its value exceeding 0.17 because of addition of a damping action brought about by the viscosity of the silicone grease.

Figure 29A:
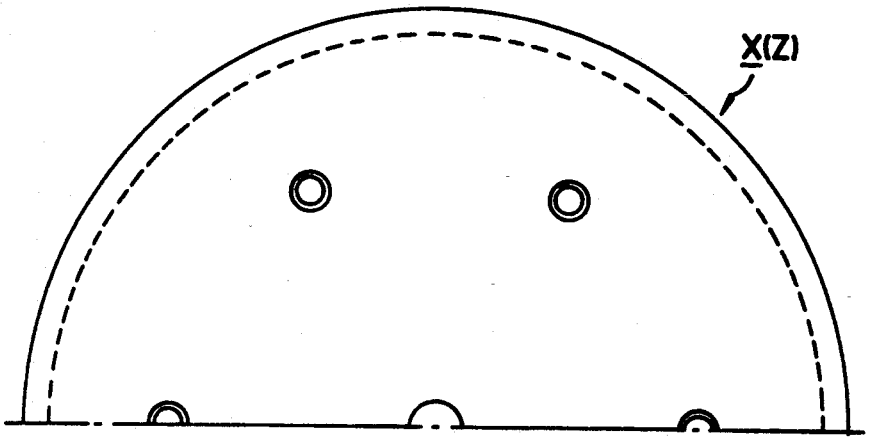
FIG.29(a) PRIOR ART
FIGS. 29 and 30 show prior art examples.
Figure 29B:
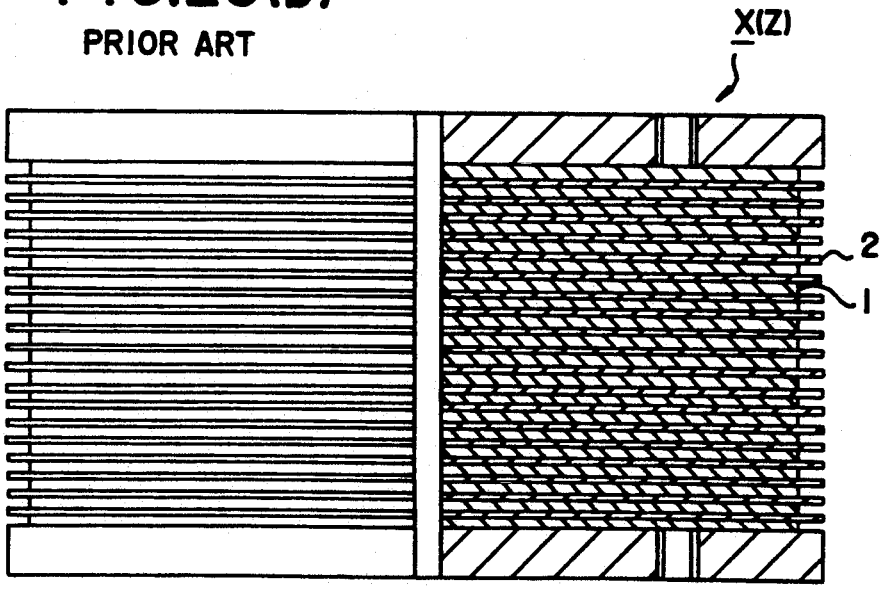
FIG.29(b) PRIOR ART

As for the vertical/shear (horizontal) rigidity ratio, kv/kh, which is a basic characteristic necessary to earthquake-proofness, a comparison between the manufacture example (FIG. 15) using natural rubber and silicone grease and the laminated rubber bearing X shown in FIG. 29 using natural rubber is shown in Table 2.

TABLE 2

| | Vertical rigidity $K_V$ TON/cm | Shear rigidity $K_H$ TON/cm | Ratio $K_V/K_H$ |
|---|---|---|---|
| 1. Embodiment A (silicone grease applied + NR parent body) | 800 | 0.33 | 2400 |
| 2. Comparative example (laminated rubber bearing) | 820 | 0.60 | 1370 |

According to Table 2, the vertical load carrying capacities are approximately equal, and the third embodiment of the invention is lower in horizontal shear rigidity kh and its rigidity ratio kv/kh is about 2 times as high. From this, it can be said that the earthquake-proofing capacity is higher than that of the prior art.

From the above comparison based on the data shown in Tables 1 and 2, it has been clarified that the earthquake-proofing device C according to the third embodiment of the invention has performance equal to or greater than that of the conventional laminated rubber bearing.

A fourth embodiment of the invention will now be described with reference to FIGS. 18 through 25.

An earthquake-proofing device D according to the fourth embodiment of the invention is constructed such that in the case where highly damping rubber, such as isobutyl-isoprene rubber or Polynorbornene, is used for a rubber-like body used as a load carrier 11, the slow rate of restoration of the highly damping rubber is compensated by a restrainer 12, whereby the range of selection of highly damping rubbers is broadened.

First, a typical example of an earthquake-proofing device D according to the fourth embodiment will be referred to as a first construction example $D_1$ and described in detail.

In the first construction example $D_1$, as shown in FIGS. 18(*a*) and (*b*), a load carrier 11 of highly damping rubber held between upper and lower pressure receiving plates 30 is inserted in a through-hole 31 vertically formed in a restrainer 12. The restrainer 12 is constructed by alternately sticking rubber-like elastic bodies 32 low in compression permanent strain and annular hard bodies 33 in the form of steel plates or the like which are restraining members and fixing them together in laminate form. In addition, the separate provision of annular pressure receiving plates 34 on the upper and lower surfaces of the restrainer 12 is in consideration of convenience of assembly, and the pressure receiving plates 34 may be integrated with the pressure receiving plates 30 in the form of rubber-like bodies.

A manufacture example $d_1$ of this first construction example $D_1$ will now be described with reference to FIGS. 19(*a*) and (*b*).

A columnar load carrier 11 using highly damping rubber is held between and fixed to pressure receiving plates 30. Rubber-like elastic bodies 32 in a restrainer 12 are joined at their inner surfaces to and integrated with the outer peripheral surface of the load carrier 11, while hard bodies 33 which are restraining members project only beyond the outer periphery of the restrainer 12.

For this highly damping rubber used for the load carrier 11, use is made of polynorbornene rubber having a tan δ of about 0.8 at a temperature of 25° C. and a frequency of 0.5 Hz, and for the rubber-like elastic bodies 32 low in compression permanent strain constituting the restrainer 12, use is made of natural rubber (NR).

A comparison of the characteristics obtained by example $d_1$ with those of the conventional laminated rubber bearing X shown in FIG. 29 and of the lead-laminated rubber bearing Y is shown in Table 3.

TABLE 3

| | Vertical compression rigidity static load 35 TON dynamic load ± 5 TON 10 HZ | Horizontal shear rigidity vertical load 35 TON: Dynamic displacement ± 5 mm 0.5 HZ TON/cm | Horizontal shear rigidity vertical load 35 TON: Dynamic displacement ± 100 mm 0.5 HZ TON/cm | Damping constant at ± 100 mm, 0.5 HZ |
|---|---|---|---|---|
| Manufacture example $d_1$ | 320 TON/cm | 0.44 | 0.27 | 0.13 |
| Comparative example X | 270 | 0.45 | 0.28 | 0.022 |
| Comparative example | 520 | 1.15 | 0.50 | 0.15 |

TABLE 3-continued

| | Vertical compression rigidity static load 35 TON dynamic load ± 5 TON 10 HZ | Horizontal shear rigidity vertical load 35 TON | | |
|---|---|---|---|---|
| | | Dynamic displacement ± 5 mm 0.5 HZ TON/cm | Dynamic displacement ± 100 mm 0.5 HZ TON/cm | Damping constant at ± 100 mm, 0.5 HZ |
| Y | | | | |

In Table 3, a look at the damping performance shows that the damping constant of the earthquake-proofing device D according to the manufacture example $d_1$ is about 0.13, indicating higher damping performance than that of the laminated rubber bearing X which is a comparative example. This value exceeds a damping constant of 0.10, which is generally required, and is desirable for practical use.

Further, the initial rigidity during shear deformation against slight vibration, which has been a problem inherent in the lead-laminated rubber bearing, is reduced to as low a value as 0.44 in contrast to 1.15 TON/cm provided by the comparative example Y; thus, it is seen that the vibration-proofing characteristic against slight vibration is improved to a great extent.

Figure 19A:
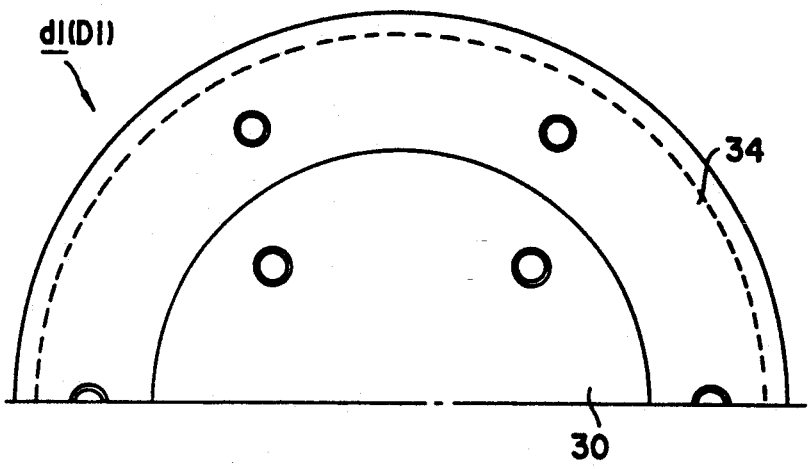
Figure 19B:
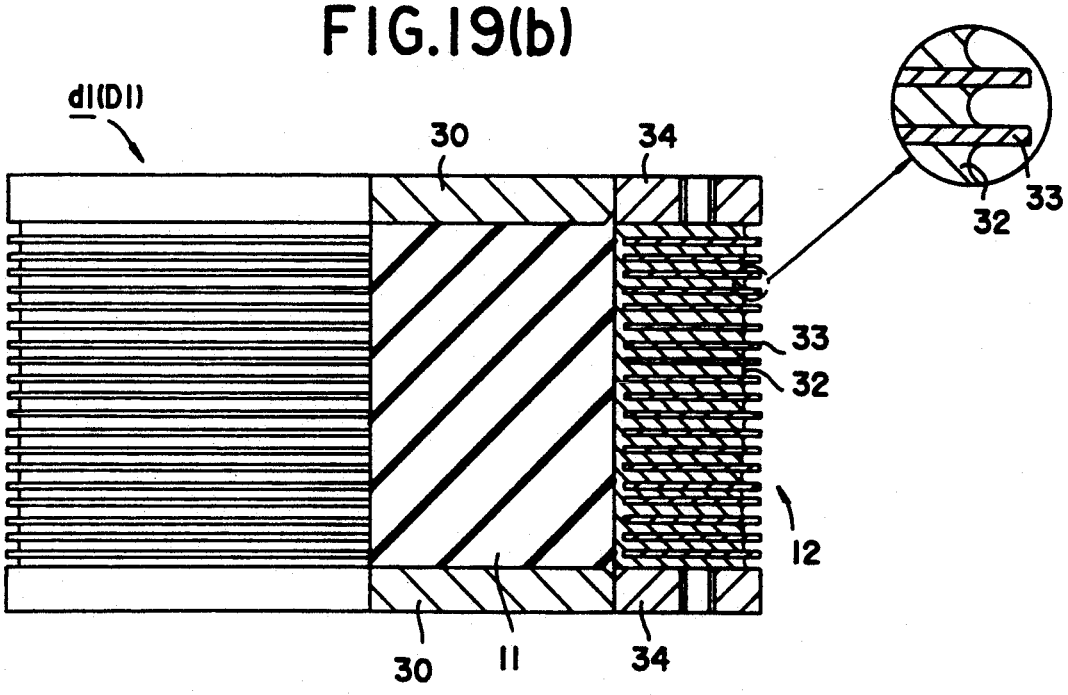

In addition, in order to check the durability of the highly damping rubber used for the load carrier 11, the earthquake-proofing device $D_1$ according to the manufacture example $d_1$ of the fourth embodiment shown in FIG. 19 was subjected to 360 times of deformation under conditions including a frequency of 0.2 Hz and an amplitude of +107 mm, and then the highly damping rubber which was the load carrier 11 was taken out of the restrainer 12 and its surface condition was observed but there was found no change on its surface as compared with what it was before the test.

Besides this, the earthquake-proofing device D of the fourth embodiment has many construction examples, which will be described in order.

Figure 20A:
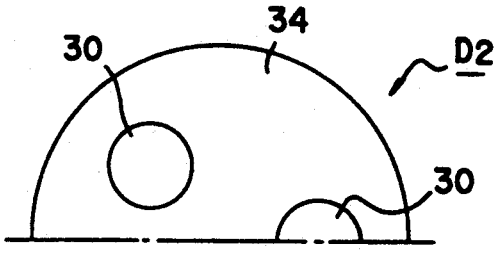
Figure 20B:
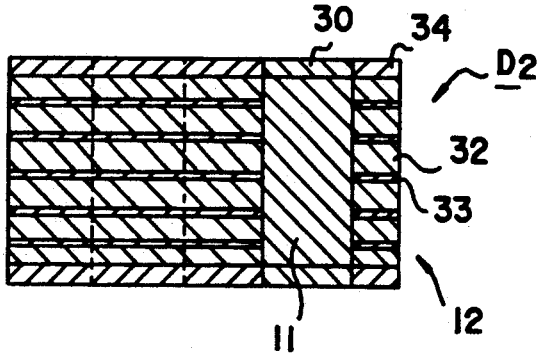
Figure 21A:
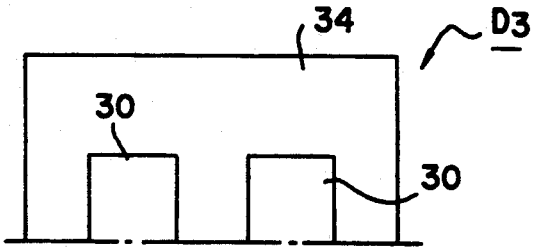
Figure 21B:
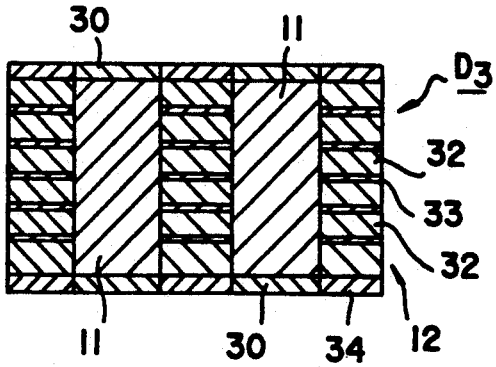

Constructions where the highly damping rubber which is a load carrier 11 is vertically extended through the restrainer 12, as in the case of the first construction example $D_1$ shown in FIG. 18, include a second construction example $D_2$ shown in FIGS. 20(*a*) and (*b*) and a third construction example $D_3$ shown in FIGS. 21(*a*) and (*b*).

These construction examples show that a plurality of highly damping rubber bodies may be inserted as load carriers 11 and that they may take any shape, such as cylinders and prisms.

Figure 22A:
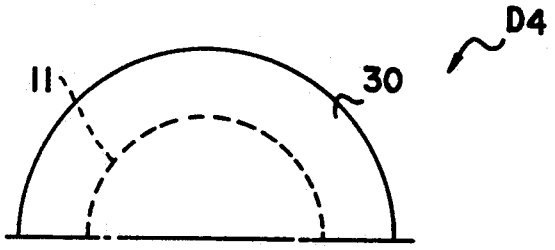
Figure 22B:
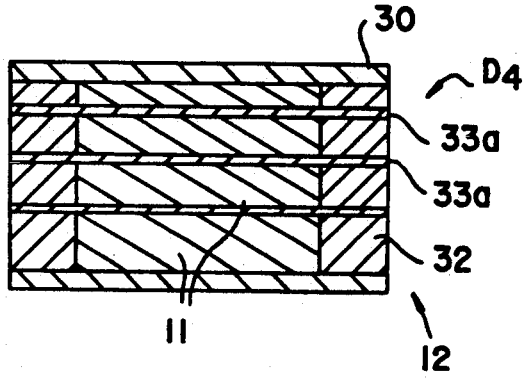
Figure 23A:
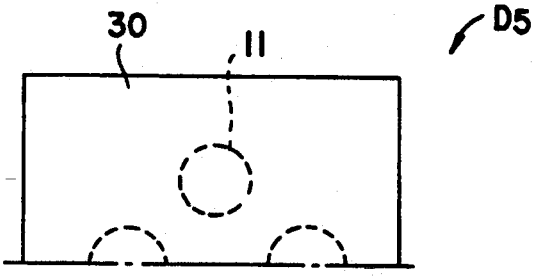
Figure 23B:
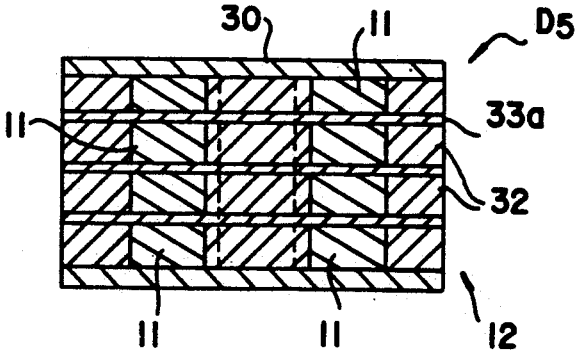
Figure 24A:
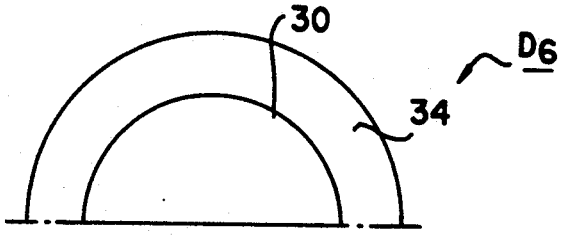
Figure 24B:
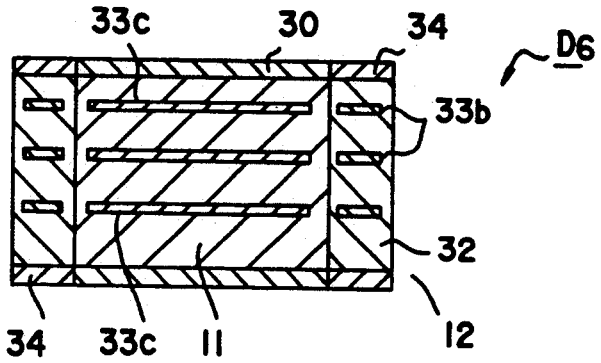
Figure 25A:
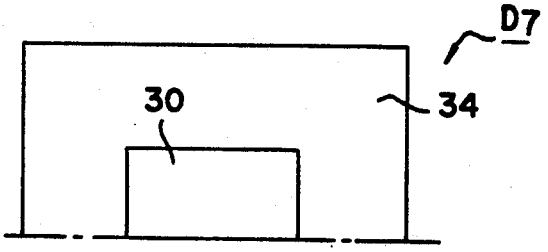
Figure 25B:
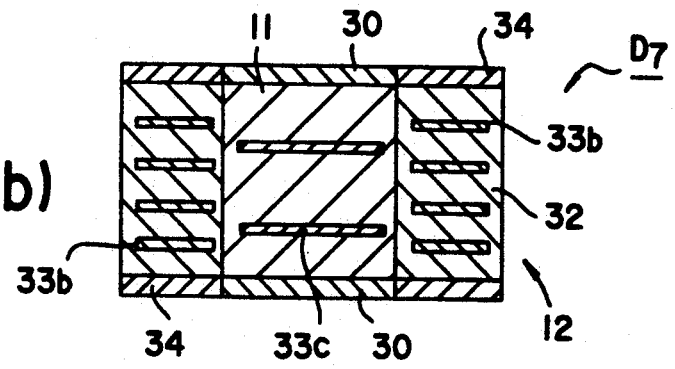

As for an arrangement in which a plurality of highly damping rubber bodies serving as load carriers 11 are disposed as they are vertically completely divided, there are a fourth construction example $D_4$ shown in FIGS. 22(*a*) and (*b*) and a fifth construction example $D_5$ shown in FIG. 23. These construction examples $D_4$ and $D_5$ use unapertured hard bodies 33*a* as restraining members, thereby vertically completely dividing the highly damping rubber which is a load carrier 11. The fourth construction example $D_4$ uses a plurality of highly damping rubber bodies in the form of flat plates as load carriers 11. The fifth construction example $D_5$ uses a restrainer 12 in the form of a quadrangular prism and four cylindrical highly damping rubber bodies serving as load carriers 11 disposed in each plane. As for an arrangement in which vertically spaced partitions for the load carriers 11 are separate from the hard bodies 33*b* which are restraining members and are provided by partition plates 33*c* embedded in the highly damping rubber, there are sixth construction example $D_6$ shown in FIGS. 24(*a*) and (*b*) and a seventh construction example $D_7$ shown in FIGS. 25(*a*) and (*b*). The differences between the sixth and seventh construction examples are in whether the shape is cylindrical or quadrangularly prismatic and in whether the partition plates 33*c* are at the same levels as the hard bodies 33*b* which are restraining members or they are disposed at alternate levels. Further, these sixth and seventh construction examples $D_6$ and $D_7$ differ from the first through fifth construction examples $D_1$ through $D_5$ in that the hard bodies 33*b* are completely embedded in the restrainer 12.

The first through seventh construction examples $D_1$ through $D_7$ which are the fourth embodiment of the invention have so far been described, but it is to be pointed out that the fourth embodiment can be implemented in a wide variety of constructions by combining, in different ways, the features of the various parts appearing in the above construction examples.

For example, in the first through fifth construction examples, the hard bodies 33 and 33*a* which are restraining members project beyond the restrainer 12, and, in contrast, in the sixth and seventh construction examples they are completely embedded; each of the forms my be employed in the respective construction examples.

In addition, in the fourth embodiment, for example, the desirable amount of compression permanent strain of the rubber-like elastic body 32 used in the restrainer 12 is 35% or less at 70° C.-22HR heat treatment based on JIS-K6301, this value being necessary to impart an appropriate restoring force to the restrainer 12. Particularly, 20% or less provides good results.

As for highly damping rubbers used in load carriers 11, those are preferable whose loss (TAN δ) at 0.5 Hz and at a dynamic strain of 0.5% ranges from 01. to 1.5. The reason is that if the loss (TAN δ) exceeds 1.5, the vertical vibration-proofness at 10 Hz and more is degraded and that if it is less than 0.1, this does not contribute so much to improving damping performance in the horizontal shear direction.

The earthquake-proofing device D of the fourth embodiment has its restrainer 12 integrated and its load carrier 11 made uniform throughout the peripheral surface and elastically restrained in a stabilized state, so that the device is characterized in that highly damping rubber high in compression permanent strain can be used in a stabilized state free from creep phenomena and in that a suitable horizontal restoring force can be imparted to the earthquake-proofing device by the elastic force of the restrainer 12.

Figure 30A:
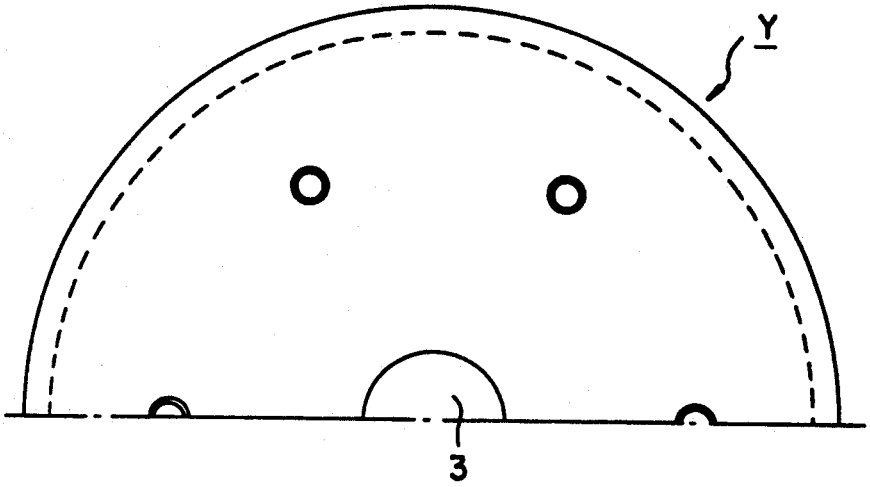
FIG.30(a) PRIOR ART
Figure 30B:
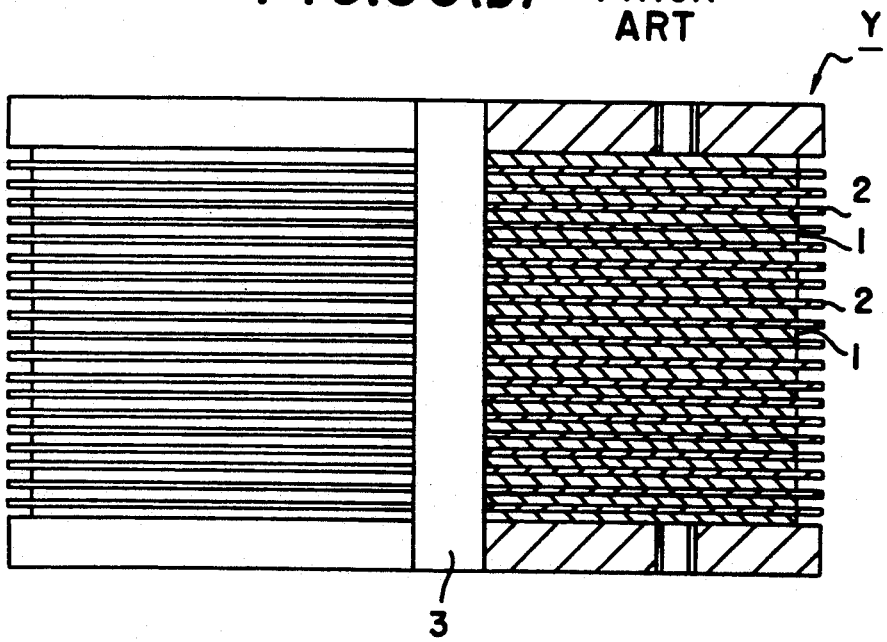
FIG.30(b) PRIOR ART
Figure 31:
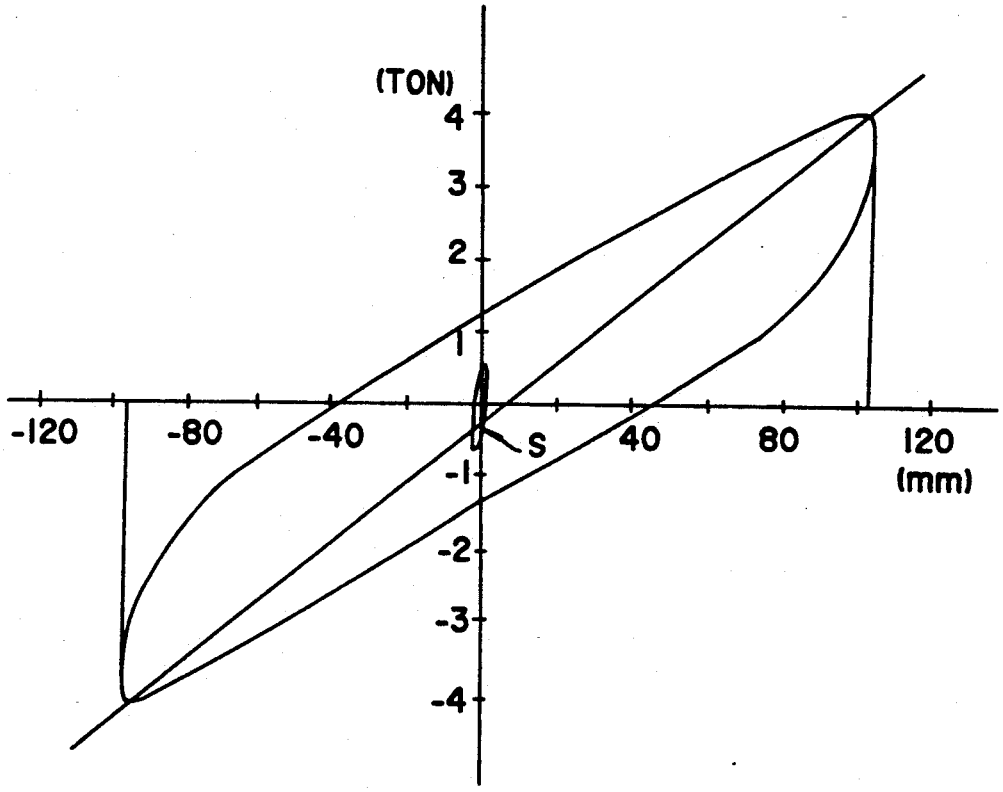
FIG. 31 is a load-displacement curve for the lead-laminated rubber bearing shown in FIG. 30.

The earthquake-proofing device D of the fourth embodiment of the invention essentially differs in mechanism from the conventional lead-laminated rubber bearing Y shown in FIG. 30 in that the vertical load is mostly supported by the highly damping rubber which is the load carrier 11 and in that energy absorption is effected mainly by intermolecular friction in the highly damping rubber. In the lead-laminated rubber bearing Y, the vertical load is supported by the peripherally disposed laminate of steel plates and thin rubber plates and energy absorption is effected by plastic deformation of the lead.

A fifth embodiment of the invention will now be described with reference to FIGS. 26 through 28.

An earthquake-proofing device E according to the fifth embodiment uses viscous fluid as a load carrier 11, wherein high vertical rigidity is imparted to the viscous fluid by restraining outward bulging while a restoring force associated with horizontal deformation is imparted to a rubber-like elastic body which is low in compression permanent strain and which constitutes the restrainer. And a damping action is provided mainly by intermolecular friction in the viscous fluid.

Typical forms of the earthquake-proofing device E of peripherally restrained type according to the fifth embodiment will now be described in order as first through third arrangement examples.

Figure 26A:
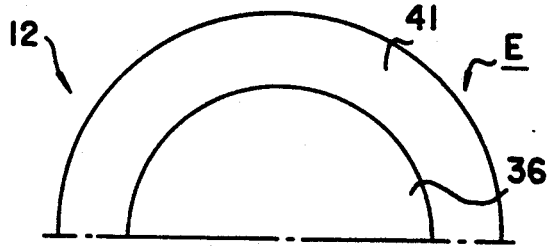
FIGS. 26 through 28 are views for explaining an earthquake-proofing device E of peripherally restrained type according to a fifth embodiment of the invention.
Figure 26B:
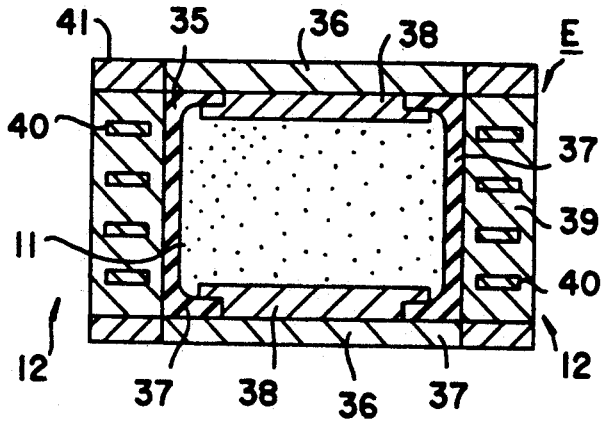

A first arrangement example, as shown in FIGS. 26(*a*) and (*b*), has viscous fluid, which is a load carrier 11, enclosed in a cavity 35 defined vertically of a cylindrical restrainer 12 with said viscous fluid placed between upper and lower pressure receiving plates 36. In addition, to ensure perfection of enclosure of the viscous fluid which is a load carrier 11, an elastic bag 37 is used and fixed in position by using bag fixing plates 38. This restrainer 12 is in the form of a laminate formed by fixing, as by vulcanization adhesion or sticking, a rubber-like elastic body 39 low in compression permanent strain and annular or spiral hard restraining members 40. Wires, such as steel wires, may be employed as restraining members. In addition, annular pressure receiving plates 41 are provided on the upper and lower surfaces of the restrainer 12 in consideration of convenience of assembly; said pressure receiving plates 41 may be integrated with the receiving plates 36 for the viscous fluid.

A second arrangement example of the earthquake-proofing device E of peripherally restrained type according to the fifth embodiment of the invention will now be described.

Figure 27A:
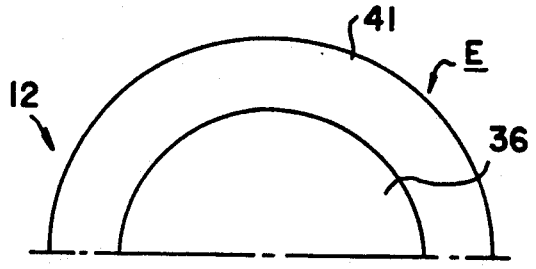
Figure 27B:
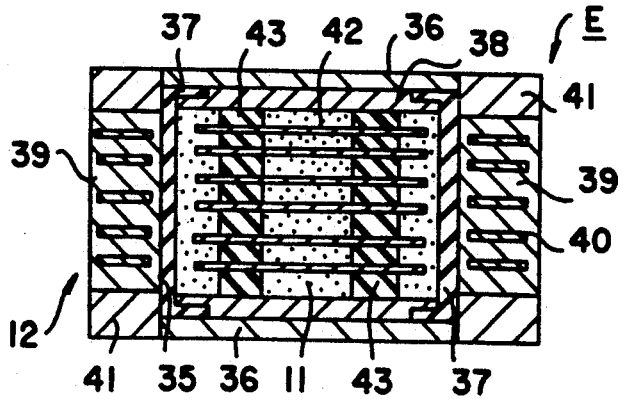

A second arrangement example shown in FIGS. 27(*a*) and (*b*) is a modification of the embodiment shown in FIGS. 26(*a*) and (*b*), wherein a plurality of viscous fluid shear resistance plates 42 are disposed in parallel to each other to control the flow of the viscous fluid so as to improve damping effect. The viscous fluid shear resistance plates 42 are connected together by a rubber-like elastic body 43 with a predetermined spacing defined between adjacent plates and are supported by a bag fixing flange 38. This embodiment enables the shear resistance force of the viscous fluid shear resistance plates to be effectively transmitted to the upper and lower pressure receiving plates 42 through the rubber-like elastic body 43, thus maintaining the clearances of the viscous fluid shear resistance plates 42 at a constant value to improve the damping effect.

Figure 28A:
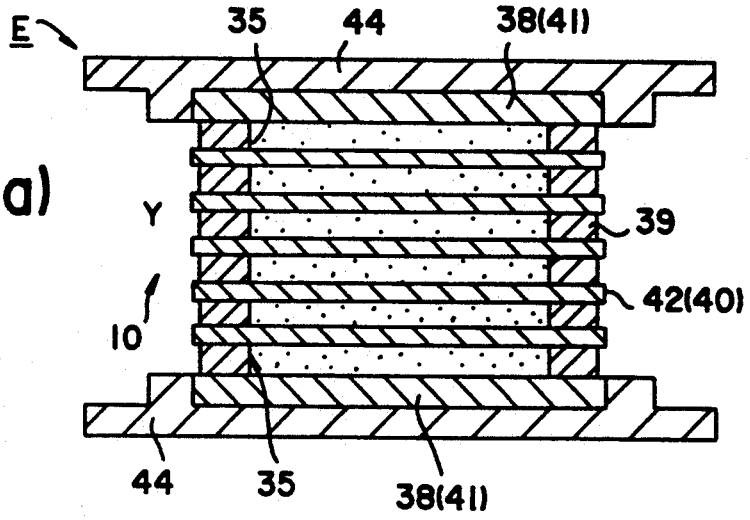
Figure 28B:
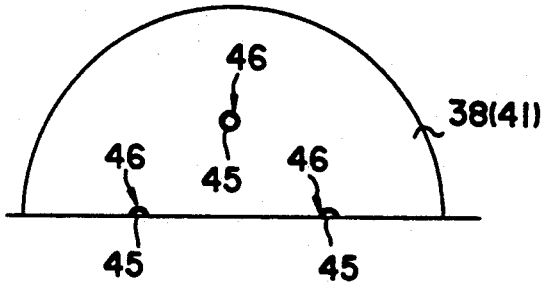
Figure 28C:
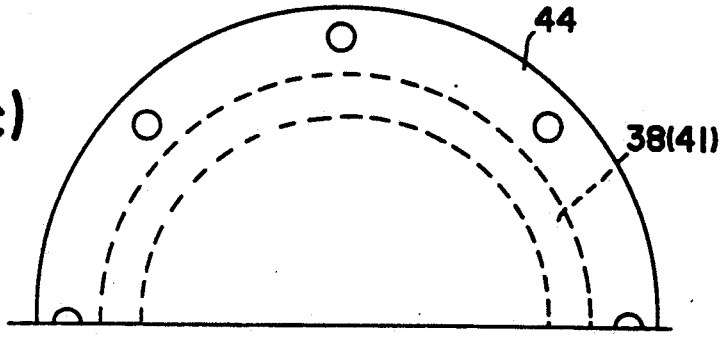

A third arrangement example of the earthquake-proofing device E of peripherally restrained type according to the fifth embodiment of the invention is shown in FIGS. 28(*a*), (*b*) and (*c*). The third arrangement example shows that viscous fluid which is a load carrier 11 may be enclosed in a plurality of chambers and that the viscous fluid shear resistance plates 42 may be integrated with the hard restraining members 40. This third arrangement example has viscous fluid, which is a load carrier 11, enclosed directly in a restrainer 12. This is because if the cavity 35 in the restrainer 12 is made sealable, then the elastic bag 37 is not absolutely necessary.

In addition, in the third arrangement example, outer plates 44 adapted to be joined to a structure and a foundation are fitted on pressure receiving plates 36. The upper pressure receiving plate 36 is formed with enclosing holes 45 for enclosing the viscous fluid which is a load carrier 11. The enclosing holes 45 are closed by bolts 46 screwed thereinto. Further, each viscous fluid shear resistance plate 42 is formed with an unillustrated through-hole to make it possible to inject viscous fluid which is to become a load carrier 11. The arrangement of this third arrangement example is based on the same concept of the second arrangement example. That is, the viscous fluid is sealed in and moreover the viscous fluid shear resistance plates 42 are installed with a small spacing y defined therebetween to enhance the intermolecular motion so as to improve the damping effect. This construction is characterized in that the smaller the spacing y, the greater the damping effect corresponding to the velocity gradient dv/dy between the viscous fluid shear resistance plates 42.

So far, the first through third arrangement examples of the earthquake-proofing device E which is the fifth embodiment have been described, but it is to be pointed out that the fifth embodiment can be implemented in a wide variety of constructions besides the above-described arrangement examples by combining, in different ways, the features of the various parts appearing in the first through third arrangement examples.

For example, in the first and second arrangement examples, the hard restraining members 40 are completely embedded in the restrainer 12, and, in contrast, in the third arrangement example, they project; each of the forms may be employed in the respective embodiments.

In addition, the desirable amount of compression permanent strain of the rubber-like elastic body 39 used in the strainer 12 is 35% or less at 70° C.-22HR heat treatment based on JIS-K6301, this value being necessary to impart an appropriate restoring force to the restrainer 12. Particularly, 20% or less provides good results.

Further, the greater the dynamic viscosity of the viscous fluid used as a load carrier 11, the higher the damping effect, but a viscous fluid having 1,000 st-100,000 st is preferable as it provides suitable damping performance.

INDUSTRIAL APPLICABILITY

The earthquake-proofing device of the present invention uses a non-laminated elastic body, visco-elastic body or viscous body to develop high vertical load support performance, making it possible to eliminate the drawbacks of conventional laminated rubber bearings, and supersedes the latter.

Particularly, since the earthquake-proofing device of the invention does not use a material having high initial rigidity, such as lead, it also has a vibration-proofing property for slight vibration and offers a wide range of selection of restrainers and load carriers, making it possible to design characteristics in a wide range, as desired. Therefore, the invention is suitable for earthquake- and vibration-proofing buildings; for earthquake- and vibration-proofing floors, and for earthquake- and vibration-proofing power transmission equipment and general equipment as well.

What is claimed is:

1. An earthquake-proofing device of a peripherally restraining type comprising:

a load carrier disposed in a restrainer opening at opposite ends for positioning below a structure for supporting a vertical load of said structure by said load carrier, said restrainer including restraining members laminated together in a vertical load direction of device for developing high rigidity tensile force, said restraining members being separated annular rigid plates stacked with a) elastic plates of rubber, low in compression permanent strain, interposed therebetween and with b) antifrictional members of a material of low friction coefficient interposed between selected plates of said restraining plates and said elastic plates, said load carrier being inserted in said restrainer surrounding said load carrier in an axial direction of said load and restraining said load carrier from bulging outward when said load carrier is loaded, said load carrier being formed of an elastic or visco-elastic material selected from a group consisting of natural rubber and derivates thereof, elastomers developing rubber-like visco-elasticity and highly damping synthetic rubbers and wherein said restrainer and load carrier having a vertical spring constant greater than a horizontal spring constant and having a damping ratio not less than 0.1.

2. An earthquake-proofing device as set forth in claim 1, wherein a loss of said highly damping synthetic rubber (TAN δ) at 0.5 Hz and at a dynamic strain of 0.5% ranges from 0.1 to 1.5.

3. An earthquake-proofing device as set forth in claim 1, wherein an amount of compression permanent strain of said elastic plates between the restraining plates is 35% or less at 70° C-22 heat treatment.

4. An earthquake-proofing device as set forth in claim 1, wherein said load carrier includes second rigid plates extending in planes perpendicular to said vertical load direction.

5. An earthquake-proofing device as set forth in claim 4, wherein said second rigid plates are arranged at the same intervals as said rigid plates in said restrainer.

6. An earthquake-proofing device as set forth in claim 6, wherein said rigid plates are in a form of wire.

7. An earthquake-proofing device as set forth in claim 6, wherein a plurality of separate wire rings are concentrically stacked, one above the other, to form said restrainer.

8. An earthquake-proofing device as set forth in claim 6, wherein a length of wire is spirally wound to form said restrainer.

9. An earthquake-proofing device as set forth in claim 6, wherein restraining wires and an elastic body are disposed in laminate form around said load carrier, said restraining wires and said elastic body alternating in the vertical direction.

10. An earthquake-proofing device as set forth in claim 1, wherein one of said selected plates is selected from said restraining plates and another of said selected plates is selected from said elastic plates, said one of said selected plates and said another of said selected plates are disposed face-to-face and said antifriction member is between said face-to-face plates.

11. An earthquake-proofing device as set forth in claim 1, wherein said selected plates are selected from said restraining plates, said selected restraining plates are disposed face-to-face and said antifriction member is between said face-to-face plates.

12. An earthquake-proofing device as set forth in claim 1, wherein said antifriction members are of a low friction coefficient material impregnated with a lubricant selected from a group consisting of silicone grease, PTFE and low friction coefficient resin lubricants.

13. An earthquake-proofing device as set forth in claim 1, wherein said antifriction members are of a low friction coefficient material coated on said selected plates, said antifriction members selected from a group consisting of silicon grease, PTFE and low friction coefficient resin lubricants.

14. An earthquake-proofing device as set forth in claim 1, wherein said antifriction members are of a low friction coefficient material which covers said selected plates, said antifriction members selected from a group consisting of silicone grease, PTFE and low friction coefficient resin lubricants.

15. An earthquake-proofing device as set forth in claim 1, wherein said highly damping rubbers are selected from the group consisting of nitrile-butadiene rubber, isobutylene-isoprene rubber, polynorbornene and butyl halogenide rubber.

16. An earthquake-proofing device as set forth in claim 1, wherein said antifriction members are PTFE sheets.

17. An earthquake-proofing device of a peripherally restraining type comprising:

a load carrier positioning below a structure for supporting a vertical load of said structure; and a restraining and energy absorption means a) for restraining said load carrier from bulging outward when said load carrier is loaded and b) for absorption of vibration energy, said restraining and energy absorption means including rigid plates and elastic plates alternately laminated together in a vertical load direction or developing high rigidity against tensile force, said load carrier being inserted inside an opening in said restraining and energy absorption means with opposite ends of said load carrier exposed, said restraining and energy absorption means surrounding said load carrier in an axial direction of said load.

18. An earthquake-proofing device as set forth in claim 17, wherein said load carrier is a viscous fluid enclosed within said restrainer.

19. An earthquake-proofing device as set forth in claim 18, wherein shear resistance plates extend horizontally through said viscous fluid.

20. An earthquake-proofing device as set forth in claim 18, wherein said fluid has viscosity of from 1,000 st–100,000 st.

21. An earthquake-proofing device as set forth in claim 20, wherein said rigid plates are a strip of plate spirally wound to form said restrainer.

22. An earthquake-proofing device as set forth in claim 17, wherein said load carriers is of highly damping rubber, and said elastic plates are a rubber which is low in compression permanent strain.

23. An earthquake-proofing device as set forth in claim 17, wherein said load carriers is of highly damping rubber and said elastic plates are low in compressive permanent strain, with antifriction members between selected plates, selected from said rigid plates and said elastic plates.

24. An earthquake-proofing device as set forth in claim 23, wherein a loss of said highly damping rubber (TAN δ) at 0.5 Hz ranges from 0.1 to 1.5.

25. An earthquake-proofing device as set forth in claim 23, wherein said antifriction members are of a material of low friction coefficient.

26. An earthquake-proofing device as set forth in claim 22, wherein said load carrier includes second rigid plates extending in planes perpendicular to said vertical load direction.

27. An earthquake-proofing device as set forth in claim 26, wherein said second rigid plates are arranged at same intervals as said rigid plates in said restraining and energy absorption means.

28. An earthquake-proofing device as set forth in claim 17, wherein said rigid plates and elastic plates are bonded together.

29. An earthquake-proofing device as set forth in claim 22, wherein said rigid plates and elastic plates are bonded together.

30. An earthquake-proofing device as set forth in claim 17, wherein said absorption of vibration energy is by frictional damping.

31. An earthquake-proofing device as set forth in claim 17, wherein a loss of said highly damping synthetic rubber (TAN δ) at 0.5 Hz and at a dynamic strain of 0.5% ranges from 0.1 to 1.5.

32. An earthquake-proofing device as set forth in claim 17, wherein an amount of compression permanent strain of said elastic plates between the restraining plates is 35% or less at 70° C-22 Hr heat treatment.

33. An earthquake-proofing device as set forth in claim 23, wherein said selected plates are selected from said elastic plates, said selected elastic plates are disposed face-to-face and said antifriction member is between said face-to-face plates.

* * * * *